United States Patent [19]

Eiselstein et al.

[11] 3,930,904

[45] Jan. 6, 1976

[54] NICKEL-IRON-CHROMIUM ALLOY WROUGHT PRODUCTS

[75] Inventors: Herbert L. Eiselstein; James C. Hosier; Ralph C. Scarberry, all of Huntington, W. Va.

[73] Assignee: The International Nickel Company, Inc., New York, N.Y.

[22] Filed: Oct. 29, 1974

[21] Appl. No.: 518,609

Related U.S. Application Data

[62] Division of Ser. No. 326,369, Jan. 24, 1973, abandoned.

[52] U.S. Cl. ..... 148/38; 75/122; 75/134 F; 75/128 G; 75/128 W; 75/171

[51] Int. Cl.[2] ..... C22C 38/44; C22C 38/48

[58] Field of Search...75/122, 128 G, 128 W, 134 F, 75/171; 148/31, 32, 38

[56] References Cited

UNITED STATES PATENTS

| | | | |
|---|---|---|---|
| 2,777,766 | 1/1957 | Binder | 75/134 F |
| 2,994,605 | 8/1961 | Gill et al. | 75/171 |
| 3,243,287 | 3/1966 | Lillys et al. | 75/124 |
| 3,492,117 | 1/1970 | Jackson et al. | 75/128 G |
| 3,547,625 | 12/1970 | Bieber et al. | 75/128 W |

FOREIGN PATENTS OR APPLICATIONS

| | | | |
|---|---|---|---|
| 980,357 | 1/1965 | United Kingdom | 75/134 F |
| 1,018,149 | 1/1966 | United Kingdom | 75/134 F |

*Primary Examiner*—L. Dewayne Rutledge
*Assistant Examiner*—Arthur J. Steiner
*Attorney, Agent, or Firm*—George N. Ziegler; Ewan C. MacQueen; Raymond J. Kenny

[57] ABSTRACT

Nickel-iron-chromium-molybdenum-columbium alloy of specially controlled composition has heat and corrosion resistance characteristics particularly useful for, inter alia, use in aqueous solutions containing chlorides.

8 Claims, 2 Drawing Figures

Figure 1:
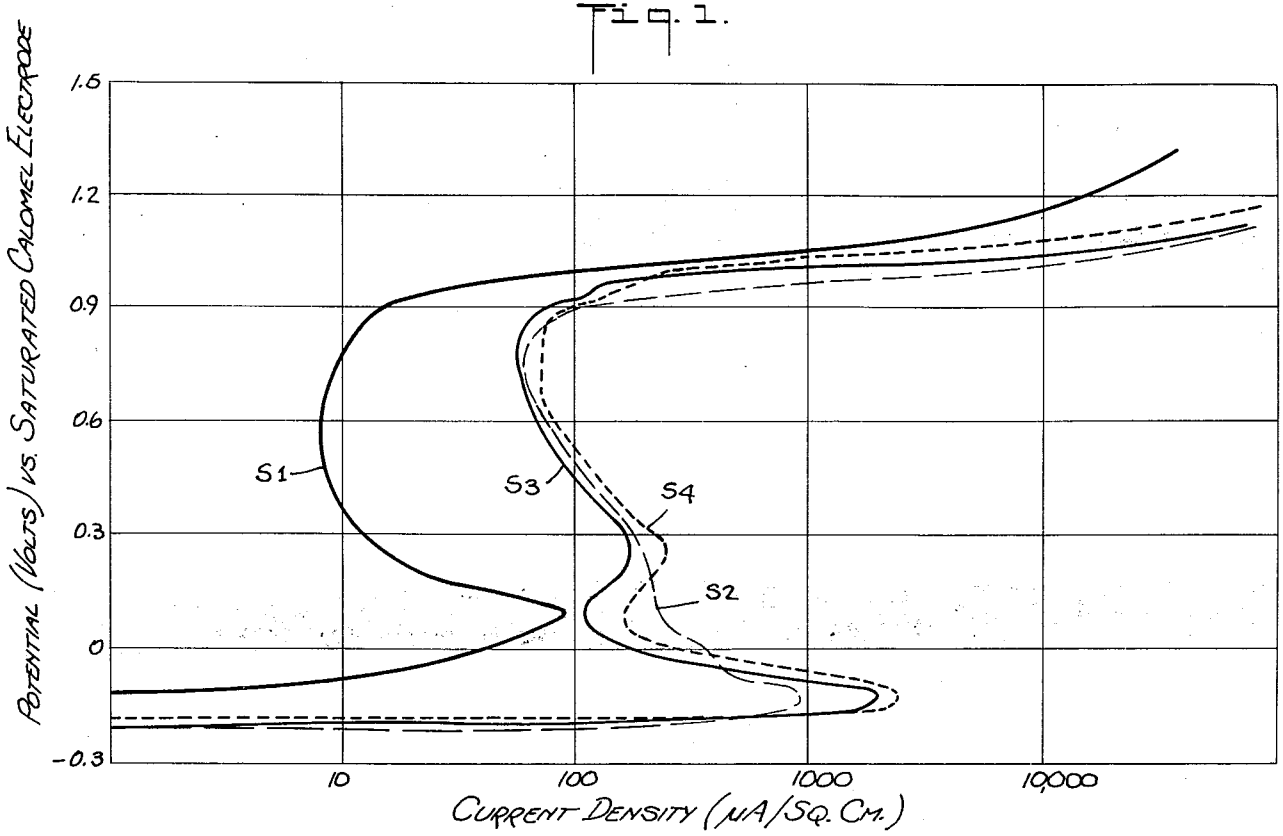

Potential (Volts) vs. Saturated Calomel Electrode
1.5
1.2
0.9
0.6
0.3
0
-0.3
10
100
1000
10,000
Current Density (μA/Sq. Cm.)
C

NICKEL-IRON-CHROMIUM ALLOY WROUGHT PRODUCTS

This is a division, of application Ser. No. 326,369, filed Jan. 24, 1973, now abandoned.

The present invention relates to nickel-iron alloys and more particularly to heat and corrosion resistant nickel-iron alloys.

It is well known that there are many needs for versatile strong corrosion-resistant alloys that can be economically produced and formed into wrought products for use at a variety of temperatures over a broad temperature range and in many different environments. Some of the more important mechanical properties often required of a strong alloy are tensile strength (including yield strength and stress-rupture strength), ductility, fatigue strength and impact resistance. Along with strength and ductility, corrosion resistance in oxidizing atmospheres or marine and other chloride environments is often needed. Furthermore, in some instances it is particularly important that an alloy be capable of retaining desired characteristics during long-time use, and thus a stable metallurgical structure that neither loses strength nor becomes embrittled during desired use is especially important. Yet, regardless of whatever success may be achieved in obtaining strength or corrosion resistance, economic considerations such as excessively high costs of materials and of manufacturing may necessitate rejecting an alloy from adoption in production when large quantities or many articles of the alloy are needed. In this connection it is desirable to utilize a substantial proportion, say, at least one-third, of a low cost material such as iron and to overcome need for using major proportions of over 50% of such more expensive materials as cobalt or nickel. Heretofore, some desirable strength and corrosion resistant characteristics have been achieved with iron, nickel and/or cobalt alloys and further strength or corrosion resistant benefits have been obtained with additions of a wide variety of elements, e.g., aluminum, chromium, columbium, molybdenum, tantalum, tungsten or others. However, alloy ingredients that provide strength or corrosion resistance may also, and at times do, render the alloy difficult or uneconomic to work into wrought products. Good workability and also good machinability are especially crucial for satisfying needs for the alloy in large quantities; for instance, for high volume production it is desirable to produce wrought products by casting large ingots and rolling the ingots down to bar, rod, strip or sheet.

There has now been discovered a nickel-iron-chromium alloy containing special proportions of nickel, iron, chromium, molybdenum, columbium and other elements, including carbon, that is especially satisfactory for economical, high volume, production of heat and corrosion resistant articles satisfactory for a broad variety of use.

It is an object of the present invention to provide a nickel-iron alloy.

A further object of the invention is to provide nickel-iron alloy wrought products and articles that are satisfactory for use over a broad range of temperatures and in a variety of environments.

Figure 2:
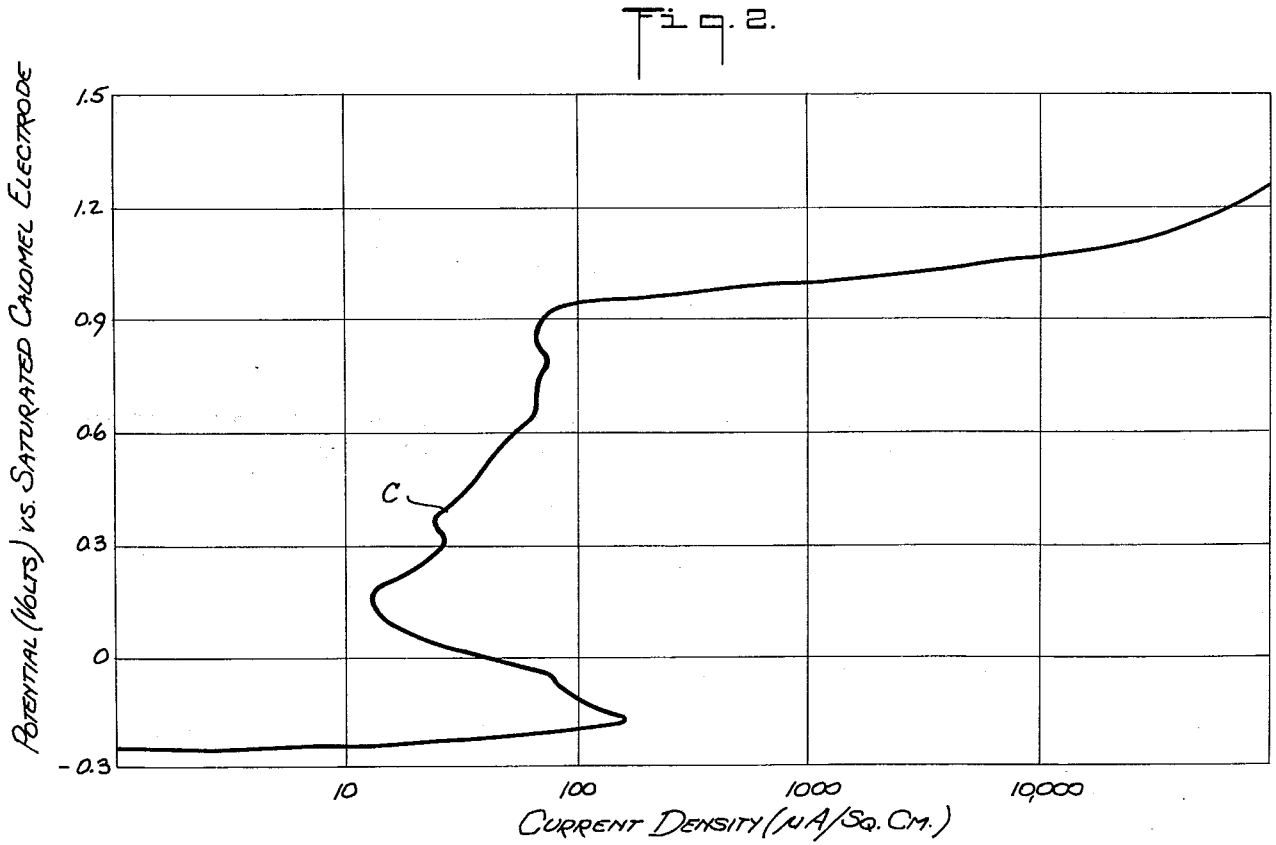

Other objects and advantages of the invention will become apparent from the following description and accompanying drawing wherein FIGS. 1 and 2 show anodic polarization curves obtained from plots, on semilog axes, of anodic potentials in volts versus current density in microamperes (amps. $\times 10^{-6}$) per square centimeter of metal/solution interface with specimens of the alloy of the invention in aqueous acid solutions.

The present invention contemplates an alloy and articles thereof containing, by weight percent, about 38% to 42% nickel, 14% to 17% chromium, 5% to 7% molybdenum, 1.5% to 2.5% columbium, up to 0.08% carbon, advantageously with carbon not exceeding 0.05%, and balance essentially iron in an amount of 29% to 40%. The alloy can also contain, and the term balance essentially does not exclude, such other ingredients as may serve auxiliary functions, e.g., deoxidation, or be present as incidental impurities, including up to 0.5% copper, up to 1.5% manganese, up to 0.5% silicon, up to 0.5% aluminum, up to 0.5% titanium, up to 0.05% calcium, up to 0.015% sulfur, and up to 0.03% phosphorus. Tantalum and tungsten may be present as incidental impurities, such as are frequently obtained with commercial sources of columbium and molybdenum, e.g., 0.05% tantalum or 0.05% tungsten.

The alloy of the invention is characterized by very good castability and workability for production of wrought products by well known economical air-melting and hot-working practices. For instance, the alloy can be induction melted and cast in an air and large ingots of 11-inch or greater thickness can be hot rolled down to ¼ inch strip. Moreover, the alloy composition enables obtaining highly desirable strength and corrosion-resistant characteristics without need for age hardening or cold working treatments. Wrought products of the alloy are characterized by yield strength (0.2% offset) of at least 30,000 pounds per square inch (psi) and 50% tensile elongation at room temperature and, at elevated temperatures, at least 20,000 psi yield strength and 50% elongation at temperatures up to 1400°F. and, also, 100 hour stress-rupture strength of at least 15,000 psi at 1400°F. in the coarse grained annealed condition, e.g., ASTM 2 to 5, obtained by heating at about 2100°F. for one hour or longer. Additional desirable strength properties of the alloy include fatigue strength and impact strength. Furthermore, and of importance for practical utilization, the alloy has beneficial characteristics of good weldability and machinability. In the fine grained annealed condition, e.g., ASTM 7 to 9, obtained by heating at about 1800°F. for 1 hour, or somewhat longer, the alloy is generally characterized by at least 65,000 psi yield strength, at least 115,000 psi ultimate tensile strength and at least 25% elongation at room temperature.

Corrosion resistant characteristics of the alloy include resistance to oxidation in air at room and elevated temperatures, resistance to corrosion by marine water and marine atmospheres, resistance to stress-corrosion cracking in chloride environments and substantial useful resistance to corrosion by acids.

Microstructure of the wrought alloy in the hot worked condition desirably comprises a relatively fine grained, solid solution, austenitic structure. In the solution annealed condition the microstructure of the alloy advantageously comprises a coarse grained, solid solution, austenitic structure. The alloy has good resistance to formation of sigma phase. For example, specimens of the alloy that were heat treated at 1400°F. for 50 hours and thereafter inspected by X-ray diffraction were entirely devoid of sigma phase. However, the formation of Laves phases can occur at temperatures of 1400°F. and upwards.

It is important for the alloy to contain a proportion of chromium of at least 14% and not greater than 17% in conjunction with the herein required proportions of 38% to 42% nickel, 5% to 7% molybdenum, 1.5% to 2.5% columbium and the other constituents referred to hereinbefore in order to achieve the desired combination of corrosion resistant, workability and long enduring strength and ductility characteristics.

For production, most of the industrial melting techniques, including induction melting or arc melting in air or vacuum and electroslag melting, are satisfactory for preparing the alloy. Electroslag melting is considered particularly beneficial for making large ingots of the alloy.

Ingots of the alloy can be converted to wrought products by hot working methods such as rolling, forging, and extrusion. Cold workability of the alloy is satisfactory for the production of sheet by methods such as rolling.

While the alloy has very good strength and useful corrosion resistance in the as-wrought condition, annealing at about 1800°F. or higher, possibly 1850°F. to 1850°F. or 1900°F., is beneficial for obtaining uniform characteristics and, particularly if the alloy has been heavily worked, for improving the ductility. The alloy can be coarse grain annealed at 2100°F. or fine grain annealed at 1800°F. Annealing periods should be about 1 hour or more per inch thickness of wrought products. Generally, stress-rupture strength increases as the annealing temperature is increased whereas short-time strength properties such as yield strength and ultimate tensile strength vary inversely with annealing temperature. For best resistance to corrosion the material should be annealed; it is best treated for general corrosion resistance and stabilized against intergranular attack by an 1800°F. anneal.

An especially advantageous composition for producing wrought products made of the alloy on a large commercial scale contains about 40% nickel, about 15.5% chromium, about 6% molybdenum, about 2% columbium, up to 0.05% carbon and balance essentially iron. Good workability for rolling large ingots down to strip is benefited by addition of deoxidizing and malleablizing elements in amounts sufficient to provide residuals of 0.05% to 0.5% aluminum and/or 0.05% to 0.5% titanium.

In order to give those skilled in the art a better understanding of the practice and advantages of the invention, the following examples and test results are set forth.

An alloy, referred to herein as alloy 1, in accordance with the invention was prepared using an induction furnace in an air atmosphere to melt nickel, chromium, molybdenum, columbium and iron together in proportions nominally about 40% nickel, 15% chromium, 6% molybdenum, 2% columbium, and balance iron. Additions of aluminum, titanium and calcium were made to the melt prior to casting. The alloy was cast and solidified in the form of a slab ingot with a cross section about 11 inches by 45 inches. The ingot was hot rolled to a slab of about 2-inch thickness, which was subsequently cut in half and one portion was rolled to one-eighth inch thickness in a strip mill. Three two-inch billets were cut from the remaining slab portion and were rolled to three-quarter inch rounds in a merchant mill. The results of chemical analysis of specimens of alloy 1 are set forth in the following Table I and results of mechanical property tests of specimens of alloy 1 are set forth in Table II. Additionally, results of analyzing and testing specimens of other alloys of the invention which also were successfully air melted and hot rolled are set forth in Tables I and II.

TABLE I

| Alloy No. | Composition, Weight Percentages | | | | | | | | | | |
|---|---|---|---|---|---|---|---|---|---|---|---|
| | Ni | Cr | Mo | Cb* | C | Mn | Si | Al | Ti | Cu | Fe |
| 1 | 39.78 | 14.80 | 6.06 | 1.95 | 0.05 | 0.39 | 0.29 | 0.30 | 0.32 | 0.02 | Bal. |
| 2 | 39.05 | 15.89 | 6.05 | 2.08 | 0.04 | 0.81 | 0.26 | 0.30 | 0.35 | 0.03 | Bal. |
| 3 | 39.96 | 15.35 | 6.03 | 2.04 | 0.04 | 0.81 | 0.28 | 0.40 | 0.32 | 0.03 | Bal. |

*Cb analyses include incidental amounts of Ta typically about 1% of Cb percentage

TABLE II

| Alloy No. | Temperature (°F.) Anneal | Test | Short Time Tensile Yield (ksi) | UTS (ksi) | Elong. (%) | Stress-Rupture Stress (ksi) | Life (Hrs.) | Elong. (%) |
|---|---|---|---|---|---|---|---|---|
| 1 | 1800 | R.T. | 72.0 | 119.0 | 33 | — | — | — |
| 1 | 1950 | R.T. | 41.9 | 101.1 | 47 | — | — | — |
| 1 | 2100 | R.T. | 33.5 | 92.5 | 53 | — | — | — |
| 1 | 1950 | 600 | 30.0 | 87.0 | 48 | — | — | — |
| 1 | 1800 | 1200 | 51.1 | 81.9 | 49 | 35 | 102 | 56 |
| 1 | 1950 | 1200 | 28.0 | 74.8 | 50 | 35 | 380 | 24 |
| 1 | 2100 | 1200 | 23.0 | 67.7 | 51 | 37.5 | 178 | 19 |
| 1 | 1800 | 1300 | — | — | — | 22.5 | 92 | 52 |
| 1 | 1950 | 1300 | — | — | — | 25 | 153 | 81 |
| 1 | 2100 | 1300 | — | — | — | 25 | 92 | 52 |
| 1 | 1800 | 1400 | 42.1 | 47.1 | 93 | 15 | 34 | 67 |
| 1 | 1950 | 1400 | 27.7 | 49.3 | 72 | 15 | 166 | 84 |
| 1 | 2100 | 1400 | 23.2 | 48.5 | 63 | 20 | 91 | 55 |
| 2 | 1800 | R.T | 68.9 | 124.5 | 30 | — | — | — |
| 2 | 1900 | R.T. | 64.6 | 118 | 34 | — | — | — |
| 2 | 2100 | R.T. | 36.6 | 99.0 | 57 | — | — | — |
| 2 | 1800 | 600 | 58.5 | 112.0 | 26 | — | — | — |
| 2 | 1800 | 1000 | 56.0 | 110.0 | 25 | — | — | — |
| 2 | 1800 | 1200 | 52.5 | 89.0 | 49 | — | — | — |

TABLE II-continued

| Alloy No. | Temperature (°F.) Anneal | Test | Short Time Tensile Yield (ksi) | UTS (ksi) | Elong. (%) | Stress-Rupture Stress (ksi) | Life (Hrs.) | Elong. (%) |
|---|---|---|---|---|---|---|---|---|
| 2 | 1800 | 1400 | 44.0 | 52.0 | 89 | — | — | — |

Anneal - Annealed one hour at indicated temperature and air cooled to room temperature
Yield - Yield at 0 – 2% offset
UTS - Ultimate Tensile Strength
Stress(ksi) - Units of 1000 pounds per square inch Room temperature hardnesses of hot-rolled specimens of alloy 1 in the conditions resulting from annealing 1 hour at 1800°F., 1950°F. and 2100°F. (followed by air cooling) were 94, 82 and 72 Rockwell B, respectively. Specimens of alloy 2 had room temperature Rb hardnesses of 96.5, 97.5, 96.0 and 78.0 in the hot-rolled and in the 1800°F., 1900°F. and 2100°F. annealed conditions, respectively. When heat treated 1 hour at 2100°F. and water quenched, alloy 2 was of 82.0 Rb hardness. A specimen of alloy 3 taken from a heavy forging hot-worked at a large cross section had a hardness of 82 Rb after annealing at 1800°F.

A Charpy V-notch impact test result with alloy 1 in the coarse-grained annealed condition was 180 ft. lbs.

Good oxidation resistance of the alloy at temperatures up to 1400°F. was evidenced by the fact that a stress rupture test exposed at 1400°F. in air under a load of 10,000 psi for about 106 hours developed a smooth, dark, protective oxide with no evidence of scaling. The alloy is particularly recommended for corrosion-resistant use in environments where articles are subjected to exposure in contact with sulfuric or hydrochloric acid. Good corrosion resistance in these acids is confirmed by the anodic polarization curves S1, S2, S3 and S4 shown on FIG. 1 and anodic polarization curve C shown on FIG. 2 of the accompanying drawing. These curves were determined potentiodynamically by ASTM method G0005 with specimens of alloy 3 of the invention in the fine-grained annealed condition. Acid solutions for the potentiodynamic determinations were: S1 — 10% sulfuric acid at ambient temperature; S2 — 10% sulfuric acid at 100°C.; S3 — 20% sulfuric acid at 100°C.; S4 — 30% sulfuric acid at 100°C.; and, C — 4% hydrochloric acid at ambient temperature. In both sulfuric acid and hydrochloric acid, at the temperature and concentration tested, the alloy evidenced a low critical current density, a wide passive potential range, low passive current density and no indication of a pitting potential. It will be recognized that these are demonstrations of beneficial corrosion resistance characteristics.

In addition to general corrosion resistance, the alloy possesses resistance to chloride-ion induced stress-corrosion cracking. Restrained U-bends were tested in boiling 45% magnesium chloride with no cracking found in a 30-day test.

The present invention is applicable to production of heat or corrosion resistant wrought products in hot or cold worked forms including plate, sheet, strip, bar, rod, rolled or extruded shapes, wire and other mill products. Moreover, the alloy of invention is particularly applicable in production of wrought articles such as fume scrubbers and propeller shafts; for such articles, the fine-grained annealed condition is especially recommended.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

We claim:

1. A high strength, corrosion-resistant, wrought and heat treated nickel-chromium-molybdenum-columbium-iron alloy product having the microstructural condition that results from annealing at about 1800°F and having a fine-grain annealed microstructure characterized by grain size of ASTM 7 and finer, a metallurgically stable solid-solution austenitic phase structure that remains essentially devoid of sigma phase and resists embrittlement when heated at 1400°F., and a room temperature yield strength of at least 65,000 pounds per square inch and composed of an alloy consisting essentially of 38% to 42% nickel, 14% to 17% chromium, 5% to 7% molybdenum, 1.5% to 2.5% columbium, up to 0.08% carbon, up to 1.5% manganese and balance essentially iron in a proportion whereby iron is at least 29% and not greater than 40% of the alloy.

2. A fume scrubber made of the product set forth in claim 1.

3. A propeller shaft made of the product set forth in claim 1.

4. A product as set forth in claim 1 wherein the alloy contains 39% to 40% nickel and 14.8% to 15.9% chromium.

5. A product as set forth in claim 1 wherein the alloy contains carbon in an amount not exeeding 0.05%.

6. A product as set forth in claim 1 wherein the alloy contains about 40% nickel, about 15.5% chromium, about 6% molybdenum, about 2% columbium and up to 0.05% carbon.

7. A product as set forth in claim 1 wherein the balance of essentially iron is restricted to not exceeding 0.5% copper, not exceeding 0.5% silicon, not exceeding 0.5% aluminum, not exceeding 0.5% titanium, not exceeding 0.05% calcium, not exceeding 0.015% sulfur and not exceeding 0.03% phosphorus.

8. A product as set forth in claim 7 containing 0.05% to 0.5% metal from the group aluminum, titanium and mixtures thereof.

* * * * *

UNITED STATES PATENT OFFICE

CERTIFICATE OF CORRECTION

PATENT NO. : 3,930,904

DATED : January 6, 1976

INVENTOR(S) : Herbert L. Eiselstein, James C. Hosier & Ralph C. Scarberry

It is certified that error appears in the above-identified patent and that said Letters Patent are hereby corrected as shown below:

Col. 3, line 22, "1850°F." should read --1750°F.--.

Col. 5, line 7 (end of Table II) "0 - 2%" should read --0.2%--.

Signed and Sealed this

Sixteenth Day of November 1976

[SEAL]

*Attest:*

RUTH C. MASON
*Attesting Officer*

C. MARSHALL DANN
*Commissioner of Patents and Trademarks*